US009170072B1

(12) United States Patent
Riggs

(10) Patent No.: US 9,170,072 B1
(45) Date of Patent: Oct. 27, 2015

(54) EASY ACCESS BALLISTIC SHIELD WITH VEHICLE DOOR MOUNT

(71) Applicant: Robert L. Riggs, Bakersfield, CA (US)

(72) Inventor: Robert L. Riggs, Bakersfield, CA (US)

( * ) Notice: Subject to any disclaimer, the term of this patent is extended or adjusted under 35 U.S.C. 154(b) by 210 days.

(21) Appl. No.: 14/082,025

(22) Filed: Nov. 15, 2013

Related U.S. Application Data

(60) Provisional application No. 61/727,596, filed on Nov. 16, 2012.

(51) Int. Cl.
*F41H 7/02* (2006.01)
*F41H 7/04* (2006.01)
*F41H 5/06* (2006.01)

(52) U.S. Cl.
CPC ... *F41H 7/04* (2013.01); *F41H 5/06* (2013.01)

(58) Field of Classification Search
USPC ..... 89/36.07, 36.01, 36.09, 36.08
See application file for complete search history.

(56) References Cited

U.S. PATENT DOCUMENTS

| | | | | |
|---|---|---|---|---|
| 5,340,189 | A * | 8/1994 | Goodman | 296/152 |
| 5,533,778 | A * | 7/1996 | Sheridan | 296/152 |
| 7,114,760 | B2 * | 10/2006 | Cameron | 296/152 |
| 7,533,600 | B2 * | 5/2009 | Marqueling | 89/36.09 |
| 7,841,269 | B1 * | 11/2010 | Jacobs | 89/36.08 |
| 2008/0190278 | A1 * | 8/2008 | Martin | 89/36.07 |
| 2013/0205983 | A1 * | 8/2013 | Martin | 89/36.07 |

* cited by examiner

*Primary Examiner* — J. Woodrow Eldred
(74) *Attorney, Agent, or Firm* — R. Scott Kimsey, Esq.; Klein DeNatale Goldner

(57) ABSTRACT

A portable ballistic shield and mount combination includes a mounting plate for attachment to a vehicle door and a ballistic shield removably engaged with the mounting plate. The ballistic shield has a handle extending outwardly therefrom. When a user of the portable ballistic shield grasps the handle and applies force away from the mounting plate, the ballistic shield detaches from the mounting plate.

13 Claims, 12 Drawing Sheets

EASY ACCESS BALLISTIC SHIELD WITH VEHICLE DOOR MOUNT

RELATED APPLICATIONS

This Application claims priority of U.S. Patent Application No. 61/727,596, filed Nov. 16, 2012, entitled "Easy Access Ballistic Shield with Vehicle Door Mount," and incorporated herein by reference in its entirety.

BACKGROUND OF THE INVENTION

1. Field of the Invention

This invention generally relates to safety apparatus for law enforcement officers and more specifically relates to an easily accessible and portable shielding device and associated mount.

2. Background

The disclosed shield and mount provide immediate access to the shield to a law enforcement officer or other individual within a vehicle.

Law enforcement officers are particularly vulnerable to attack from small caliber arms or other projectile launching devices when the officers are seated within a vehicle. For example, it is known for assailants to fire weapons at law enforcement officers as the officer is writing a citation or preparing other paper work in the vehicle, or when the officer is merely parked alongside a roadway and observing traffic. While it is common for law enforcement officers to wear protective vests which protect their chest and abdomen, the officer's head, neck, shoulders, and upper arms are typically exposed. While the use of shield devices is known, typically when used with riot gear, the conventional shields are not readily available for use and easy access while the office is seated within the vehicle.

Conventional shields have the desirable feature of providing protection for a large portion of the officer's body, and are therefore sized accordingly. However, such shields are, by necessity, stored in the trunk or back seat of the vehicle and are therefore not readily accessed by an officer seated in the front seat of a vehicle. Unfortunately, there are no known ballistic shields which may be accessed immediately by an officer seated within his or her vehicle. Given the amount of time officers may spend seated within their vehicles, the officer may have significant exposure to being fired upon by hostile individuals.

Examples of patented shield devices include U.S. Pat. No. 4,412,495 to Sankar; U.S. Pat. No. 4,843,947 to Bauer et al.; U.S. Pat. No. 4,674,394 to Martino; U.S. Pat. No. 4,782,735 to Mui et al.; U.S. Pat. No. 5,850,052 to Gabriel; U.S. Pat. No. 5,392,686 to Sankar; U.S. Pat. No. 6,389,949 to Carreira; U.S. Pat. No. 7,124,675 to Sand; U.S. Pat. No. 7,594,515 to Prock; and U.S. Pat. No. 7,971,516 to Hogan, which are all illustrative of such prior art. While these devices may be suitable for the particular purpose to which they address, they are not readily accessible to an officer seated within the front seat of a vehicle. None of the generally known devices is mountable to the inside panel of the vehicle door, thereby providing the officer easy access to a protective shield when a need arises unexpectedly.

SUMMARY OF THE INVENTION

Embodiments of the method and apparatus disclosed herein provide a solution to the problem described above. It is to be understood that while the present discussion identifies the user as a law enforcement officer, the present invention has utility to any individual wishing to reduce their exposure to small arms fire, which is defined to include handguns and rifles. Thus, the present invention has utility to not only law enforcement officers, but also to security and military personnel, as well as any other individuals concerned of the threat of small arms attack while seated in their vehicle. In addition, while the drawings herein show the present invention mounted on the driver's side front door, embodiments of the device may be utilized on other vehicle doors, including the passenger side front door, as well as the back doors of the vehicle. Moreover, the shield portion of the present invention may be utilized for protection outside of the vehicle.

An embodiment of the apparatus provides a portable ballistic shield and mount combination which comprises a mounting plate that may be manually attached and removed from an inside panel of a vehicle door. The mounting plate is preferably attached to the inside panel of a vehicle door to expedite and facilitate the ability of the user to quickly access and remove the ballistic shield from the mount. The preferred door panel for removable attachment of the mount is an inside panel having a top bounded by a window opening and a bottom bounded by an arm rest. The mounting plate has an inside surface and outside surface, such that when the mounting plate is manually attached to the inside panel, the inside surface abuts a portion of the inside panel. The mounting plate is bounded by an upper edge, a lower edge, a rear edge, and a forward edge. The upper edge comprises a hanger member which suspends the mounting plate from the top of the inside panel such that the lower edge may be above or in engaging contact with the arm rest of the vehicle door. The invention further comprises a ballistic shield which has a first surface and a second surface. The first surface comprises means for removably attaching the ballistic shield to the mounting plate. The ballistic shield further comprises a handle member which extends outwardly from the second surface.

Various mounting means may be utilized for temporarily securing the ballistic shield to the mount. It is to be appreciated that the mounting means should be of a type which secures the shield to the mount in a position readily accessible by the user. Hence, the mounting means should not allow the shield to shift or fall off during routine operation of the vehicle. Otherwise, the shield may not be available when needed in an emergency. However, the mounting means must also allow the user to immediately remove the shield from the mount with a practiced motion, such that the shield is quickly and reliably removed. The mounting means may comprise clips which may be lifted out of contoured-scalloped apertures in the mount. As an additional safety measure, the clips may be designed so as to break away upon a predetermined force applied by the user. Alternatively, the shield might attach to the mount with magnetic means, where one or both of the engaging surfaces of the mount and shield have magnets attached for attachment to corresponding magnets or metallic members in the opposing surface.

The portable ballistic shield may include a first portion having a hanger member for suspending the portable ballistic shield from the interior of a vehicle door, and a second portion including a ballistic shield and having a handle extending therefrom.

The first portion of the ballistic shield and the second portion of the ballistic shield may be releasably engaged with one another.

DETAILED DESCRIPTION OF THE INVENTION

Figure 1:
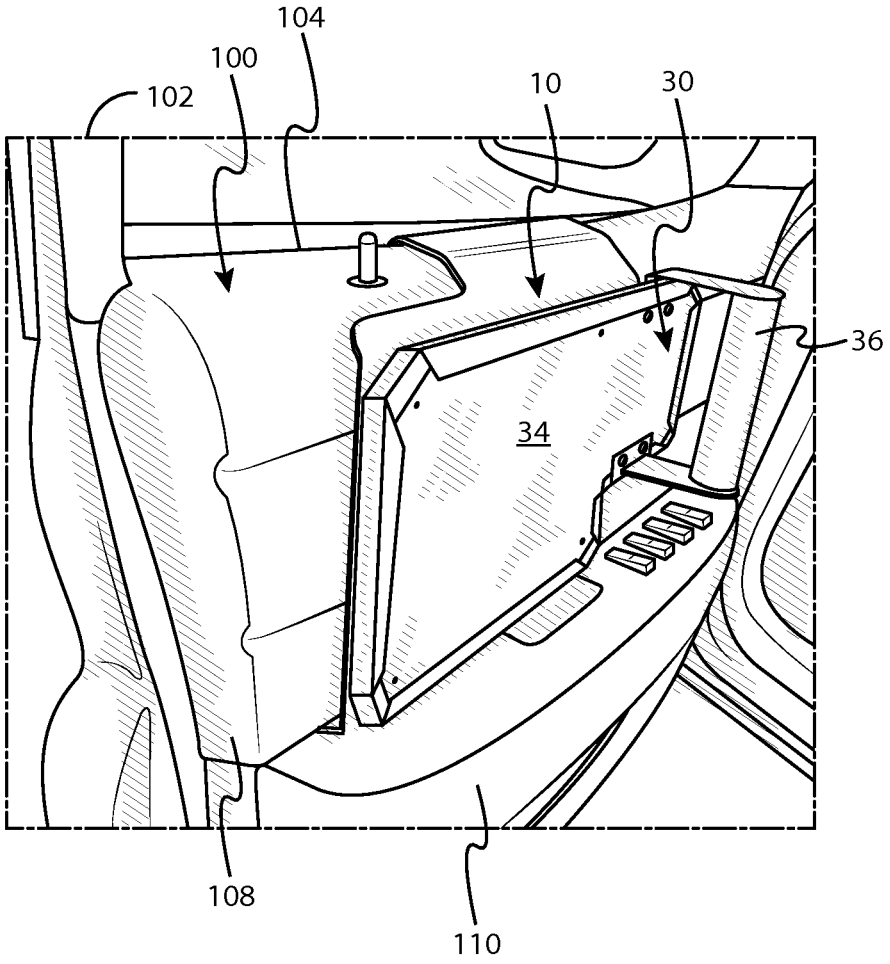
FIG. 1 shows an oblique view of an embodiment of the invention removably attached to the inside panel of a vehicle door.

Referring specifically to the figures, FIG. 1 depicts an embodiment of the shield-mount combination 10 mounted onto a panel 100 of a vehicle door 102. The panel 100 has a top 104 bounded by a window opening 106 and a bottom 108 bounded by an arm rest 110. Also shown are ballistic shield 30 and handle 36 attached thereto, as well as second surface 34 of ballistic shield 30.

Figure 2:
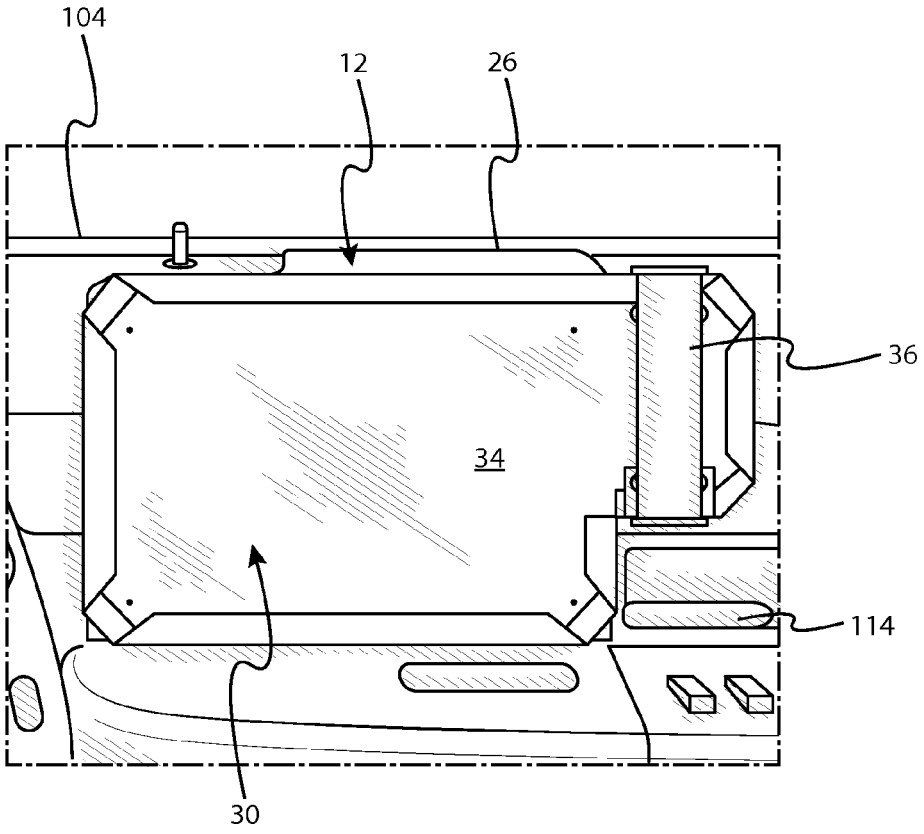
FIG. 2 shows a front view of an embodiment of the invention removably attached on the inside panel of a vehicle door.

FIG. 2 provides a front view of the embodiment of shield-mount combination 10 shown in FIG. 1. Second surface 34 of ballistic shield 30 is readily visible.

Figure 3:
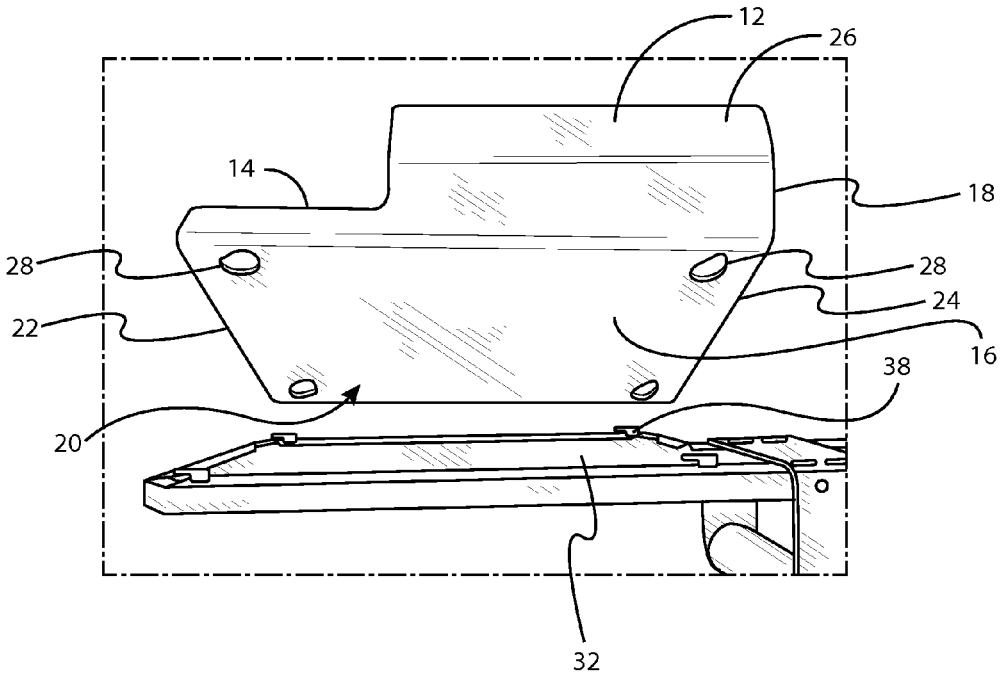
FIG. 3 shows a top view of embodiments of the mount and shield separated from one another.
Figure 5:
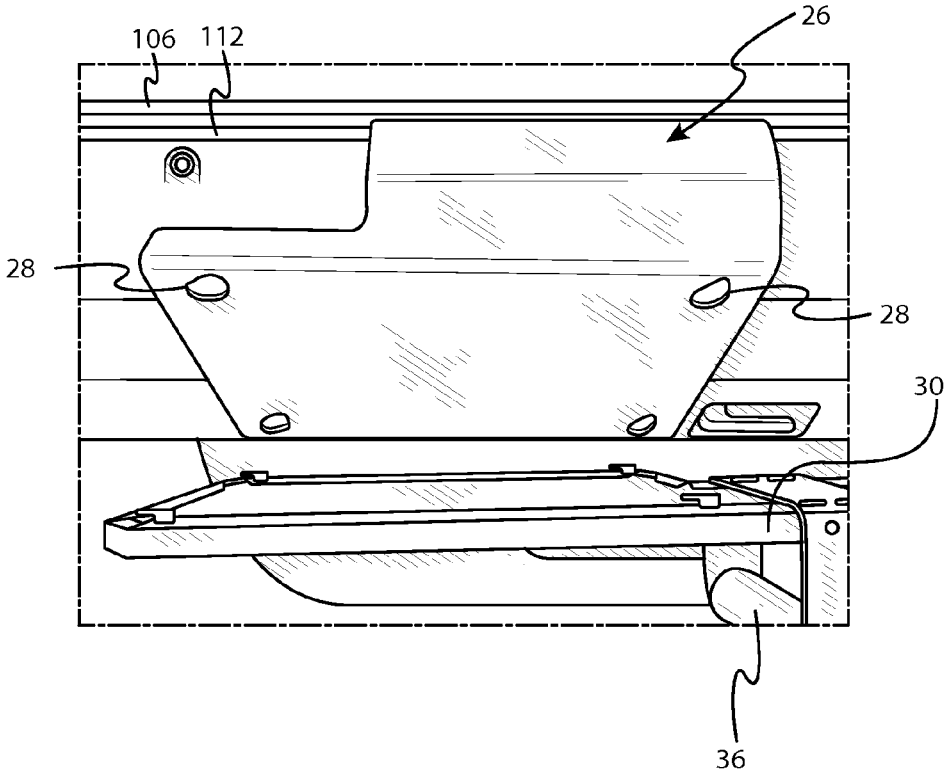
FIG. 5 shows a top view of an embodiment of the mount portion of the invention removably attached on the inside panel of a vehicle door.

FIG. 3 depicts mounting plate 12 and ballistic shield 30 from the top, with the two components of shield-mount combination 10 separated from one another. The mounting plate 12 has an inside surface 14 and outside surface 16, such that when the mounting plate 12 is manually attached to the inside panel 100, the inside surface 14 abuts a portion of the inside panel as shown in the figures. The mounting plate 12 is bounded by an upper edge 18 and a lower edge 20. The mounting plate also has a rear edge 22 and a forward edge 24, which directions correspond to the rear and front of the vehicle The upper edge 18 comprises a hanger member 26 which suspends the mounting plate 12 from the top 104 of the inside panel 100. When so mounted, the lower edge 20 of the mounting plate 12 may be above or in engaging contact with the arm rest 110 of the vehicle door 102. As shown in FIG. 1, for example, the hanger member 26 may comprise a portion of the mounting plate 12 which has been formed or molded to conform to the shape of the top 104 of the door panel. The hanger member 26 may also comprise a leading edge which slips inside the window opening, bounded by first side 106 and second side 112, to securely attach the mounting plate 12 to the inside panel 100. In this embodiment, the leading edge will rest against second side 112 of the window opening so as to not interfere with the opening and closing of the vehicle window, as best shown in FIG. 5. As shown in the figures, the mounting plate 12 may have cut-out portions which fit around or allow access to the various functional devices in the vehicle door 102, such as the door lock apparatus, inside door handle 114, and the like.

Figure 4:
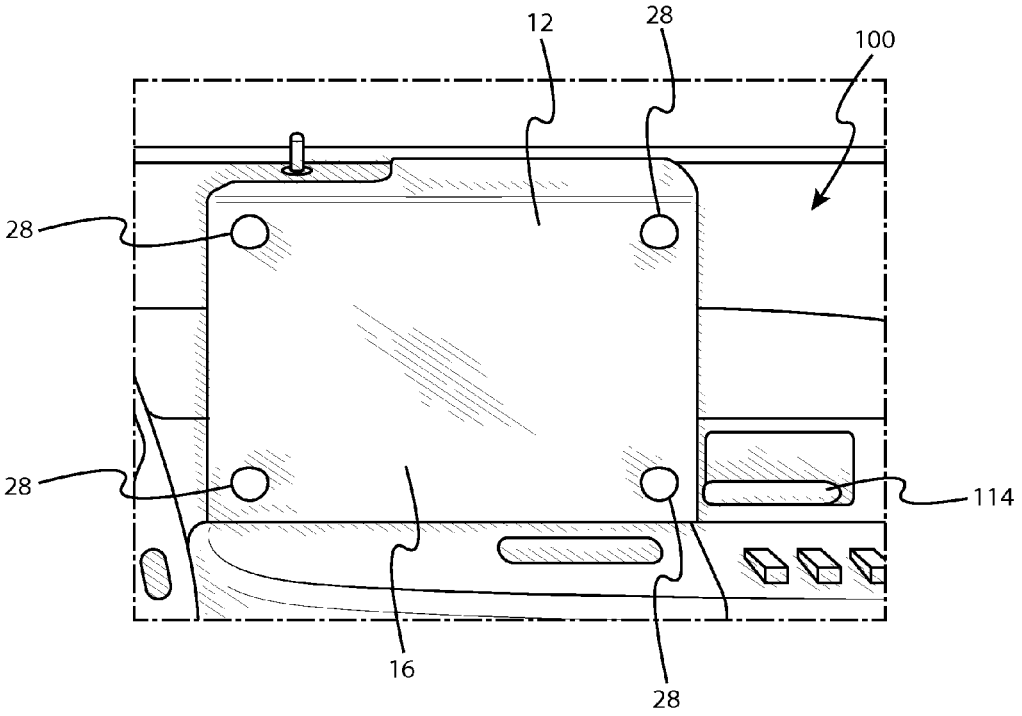
FIG. 4 shows a front view of an embodiment of the mount portion of the invention removably attached on the inside panel of a vehicle door.

FIG. 4 shows a front view of mounting plate 12, with mountain plate 12 attached to the inside panel of a vehicle door. As shown in FIG. 4 and elsewhere, mounting plate 12 also comprises a portion of the means utilized for temporarily attaching the ballistic shield 30 to the mounting plate. For example, mounting plate 12 may comprise apertures 28 which are utilized in conjunction with structural members attached to the ballistic shield 30 for temporarily attaching the shield to the mounting plate. As show in greater detail in FIGS. 9-10, apertures 28 may comprise a scooped or scalloped edge 29 which facilitates the removal of the structural members of the ballistic shield. The inventor herein has determined that a scooped or scalloped edge 29 located at approximately the two o'clock position of the aperture 28 (when looking towards outside surface 16, as depicted in FIG. 4) provides an acceptable contour for rapid withdrawal of the structural members. Any suitable positioning or contouring may be used.

FIG. 5 is a top view of one embodiment of a shield-mount combination 10, showing mounting plate 12 and ballistic shield 30 separated. Hanger member 26 is shown inserted into the window opening of vehicle door 102, the opening bounded by first side 106 and second side 112. Apertures 28 of mounting plate 12 are shown, as is handle 36 attached to ballistic shield 30.

Figure 6:
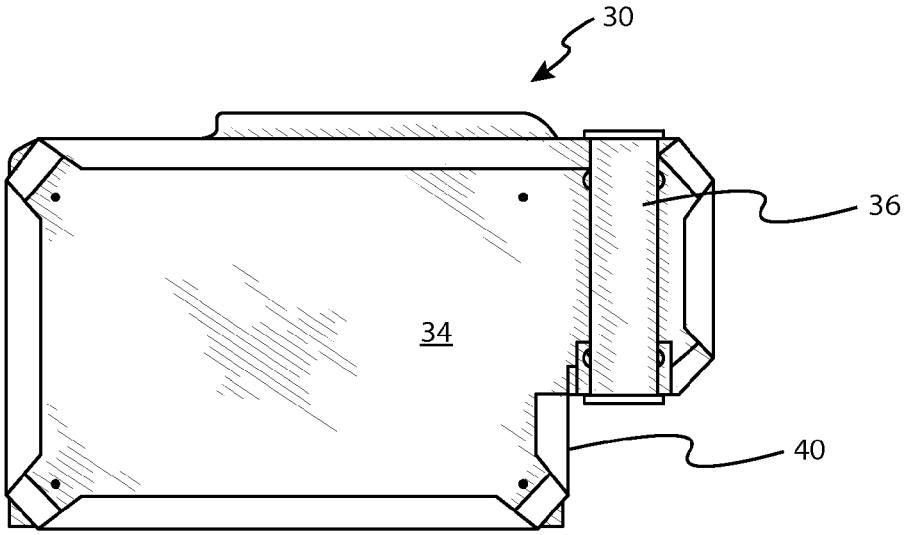
FIG. 6 shows a view of the back of an embodiment of the shield-mount of the invention.

FIG. 6 shows one embodiment of shield-mount 10. Ballistic shield 30 is shown from the back, with second surface 34 visible as it would be to an occupant of a vehicle when shield-mount 10 is mounted on a vehicle door as described herein. Handle 36 is also shown.

Various mounting means may be utilized for temporarily securing the ballistic shield 30 to the mounting plate 12. It is to be appreciated that the mounting means should be of a type which secures the shield 30 to the mounting plate 12 in a position readily accessible by the user, such as immediately adjacent to the driver's left arm as depicted in the Figures. Hence, the mounting means should not allow the shield 30 to shift or fall off of the mounting plate 12 during routine operation of the vehicle. Otherwise, the ballistic shield 30 may not be available when needed in an emergency. However, the mounting means must also allow the user to immediately remove the ballistic shield 30 from the mounting plate 12 with a practiced motion, such that the shield is quickly and reliably removed.

Figure 7:
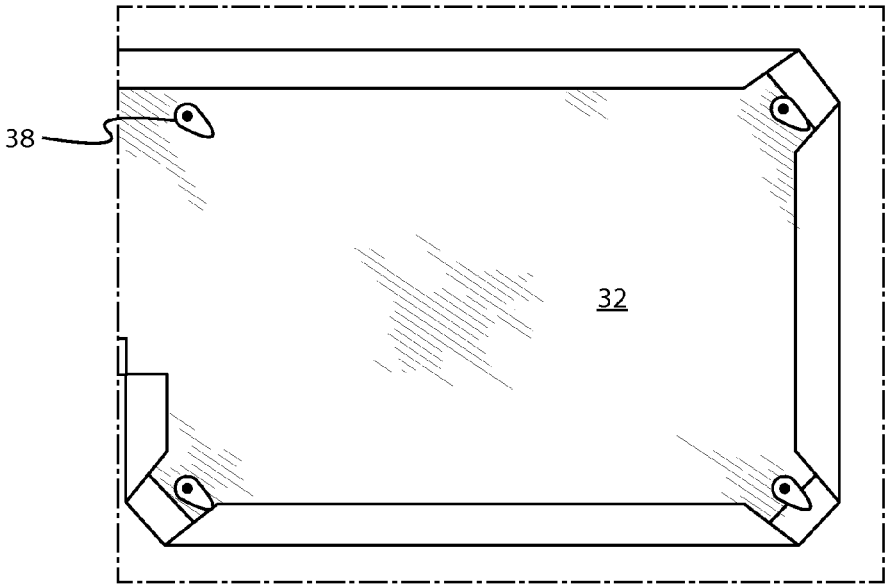
FIG. 7 shows a view of the front of an embodiment of the shield portion of the invention.
Figure 8:
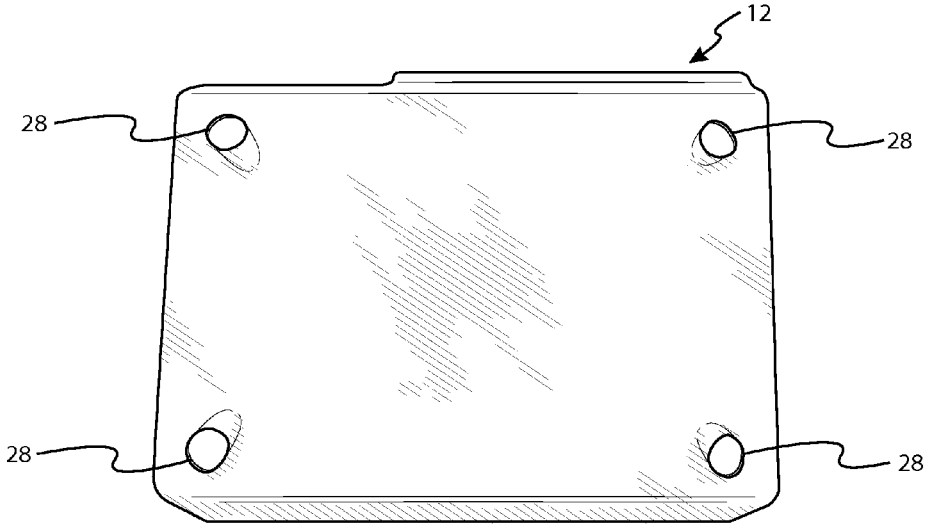
FIG. 8 shows a front view of an embodiment of the mount portion.
Figure 9:
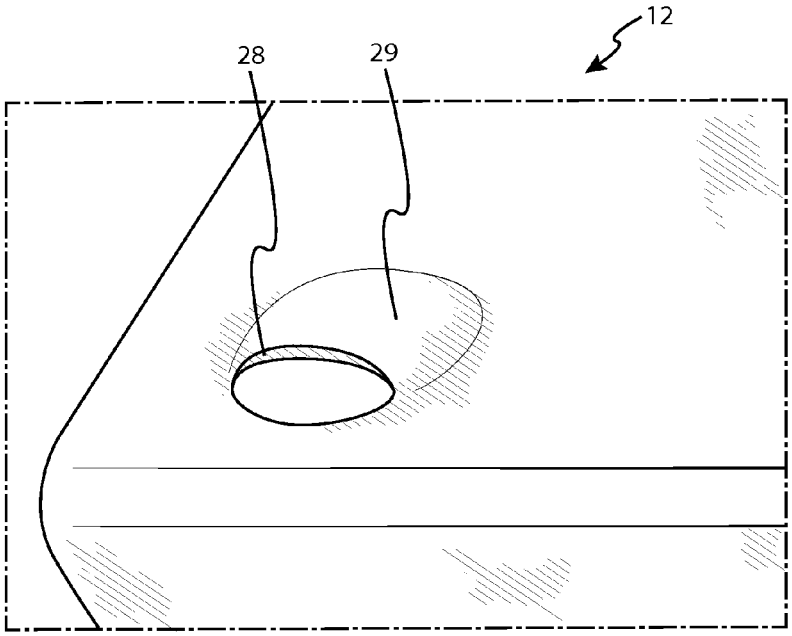
FIG. 9 shows a close-up view of one of the apertures which may be utilized in an embodiment of the mount portion of the invention.
Figure 10:
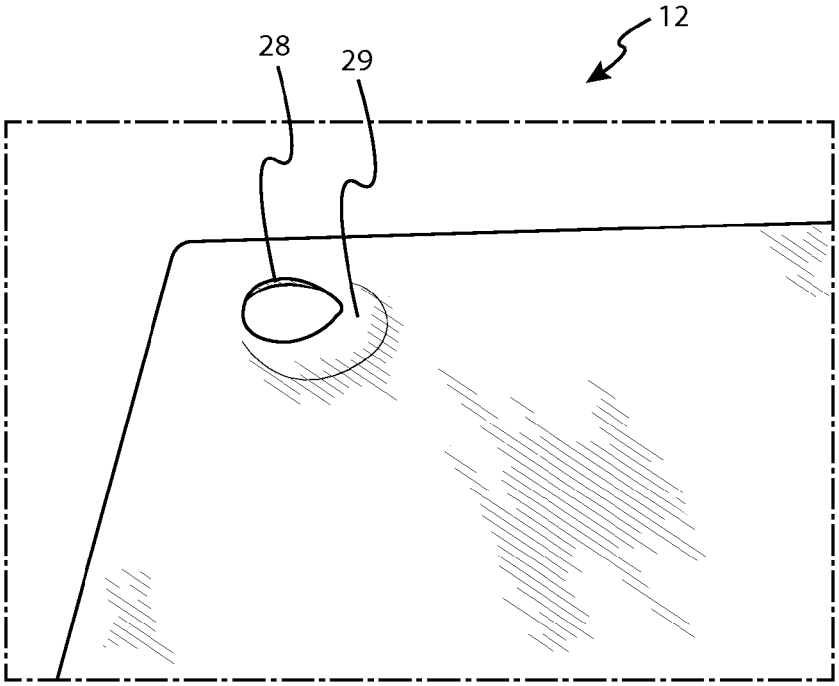
FIG. 10 shows a second close-up view of one of the apertures which may be utilized in an embodiment of the mount portion of the invention.

FIG. 7 depicts the front of one embodiment of ballistic shield 30. First surface 32 thereof is visible. The mounting means shown in FIG. 7 comprises clips 38, which may be lifted out of contoured-scalloped apertures 28 in the mount. As an additional safety measure, the clips 38 may be designed so as to break away upon a predetermined force applied by the user. Alternatively, the ballistic shield 30 might attach to the mounting plate 12 with magnetic means, where one or both of the engaging surfaces of the mounting plate 12 and shield 30 have magnets attached for attachment to corresponding magnets or metallic members in the opposing surface. Looped fasteners, such as VELCRO might also be utilized for attaching the ballistic shield 30 to the mounting plate 12. Any suitable fastening means may be utilized to attach ballistic shield 30 to mounting plate 12. FIGS. 8 through 10 show exemplary positioning of apertures 28 in mounting plate 12, as well as the contoured or scalloped portions thereof.

Ballistic shield 30 may comprise a cutout portion 40, such as shown in FIG. 2, to allow access to the door handle 114.

The ballistic shield 30 may also comprise a flashlight attachment bracket (not shown) which allows the user to attach a flashlight to the handle 36 or other portion of the ballistic shield. Such attachment may provide utility to a law enforcement officer when leaving the vehicle while carrying the ballistic shield, in that the law enforcement officer is left with one free hand. Various brackets or other attachment structures for securing a flashlight to a structure are known in the art, and it is contemplated that any suitable such structure may be used.

Figure 11:
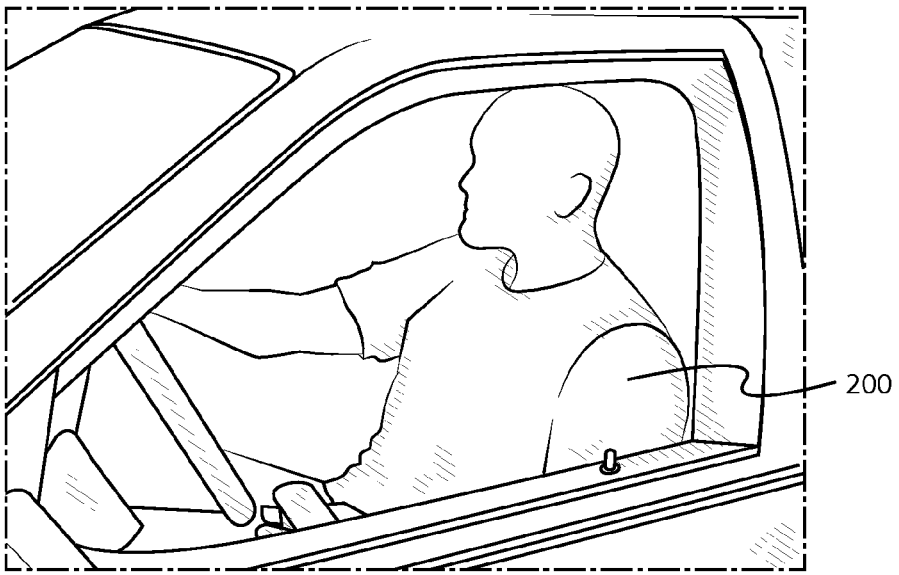
FIG. 11 depicts a view of a law enforcement officer seated in a vehicle, showing the exposure of the officer to small arms fire from outside the vehicle.
Figure 12:
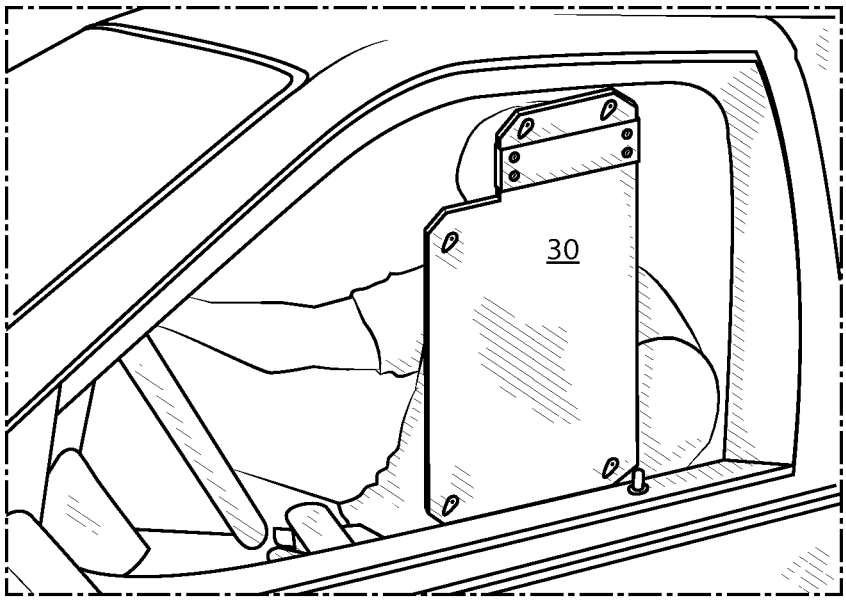
FIG. 12 shows a view of a law enforcement officer of FIG. 11, raising the shield portion of the present invention as protection to small arms fire to the head, neck, and portions of the arm and shoulder.

FIGS. 11 and 12 depict a method of using the disclosed invention. In FIG. 11, and individual 200 is seated within a vehicle. Shield-mount combination 10 is mounted within the vehicle, though the present of shield-mount combination 10 is not necessarily visible to an onlooker. Upon necessity, an individual 200 seated within a vehicle may grab the ballistic shield 30 with the arm closest the door panel 100, such as the left arm when the user is the driver, pull the ballistic shield 30 free of the mounting plate 12 and raise the shield 30 in front of the user's head, neck, and other portions of the upper torso. FIG. 12 shows individual 200 with ballistic shield 30 raised to protect against attach.

Ballistic shield 30 is fabricated from materials known in the art for stopping small arms projectiles, such as bullet resistant fiberglass, which is a reinforced plastic material consisting of multiple layers of woven roving ballistic grade fiberglass cloth impregnated with a thermoset polyester resin and compressed into rigid flat sheets. Any suitable material may be used.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the forthcoming claims of the application for utility patent.

Having thus described the preferred embodiment of the invention, what is claimed as new and desired to be protected by Letters Patent includes the following:

The invention claimed is:

1. A portable ballistic shield and mount combination, comprising:

a mounting plate which may be manually attached and removed from an inside panel of a vehicle door, the inside panel having a top bounded by a window opening and a bottom bounded by an arm rest, the mounting plate further comprising an inside surface and outside surface, wherein when the mounting plate is manually attached to the inside panel, the inside surface abuts a portion of the inside panel, the mounting plate bounded by an upper edge, a lower edge, a rear edge, and a forward edge, wherein the upper edge comprises a hanger member which suspends the mounting plate from the top of the inside panel such that the lower edge is above or in engaging contact with the arm rest; and a ballistic shield having a first surface and a second surface, wherein the first surface comprises means for removably attaching the ballistic shield to the mounting plate, the ballistic shield further comprising a handle member extending outwardly from the second surface.

2. The portable ballistic shield and mount combination of claim 1 wherein the means for removeably attaching the ballistic shield to the mounting plate comprises the first surface of the ballistic shield comprising at least one clip member and the outside surface of the mount comprising at least one aperture, wherein the clip member may be inserted into the aperture thereby temporarily suspending the portable ballistic shield from the mount.

3. The portable ballistic shield and mount combination of claim 1 wherein the means for removeably attaching the ballistic shield to the mounting plate comprises a plurality of magnets attached to the first surface of the ballistic shield and the outside surface of the mount comprises a plurality of metallic engagement plates, each engagement plate having a position on the outside surface which is in opposite facing relation with a position of one of the plurality of magnets on the first surface.

4. The portable ballistic shield and mount combination according to claim 1, further comprising a flashlight fastener attached to the ballistic shield for removably attaching a flashlight thereto.

5. A portable ballistic shield and mount combination comprising:

a mounting plate for attachment to a vehicle door; and a ballistic shield removably engaged with the mounting plate, the ballistic shield comprising a handle extending outwardly therefrom, wherein a user of the portable ballistic shield is able to disengage the ballistic shield from the mounting plate by grasping the handle and applying force away from the mounting plate.

6. The portable ballistic shield according to claim 5, wherein said mounting plate comprises at least one aperture and said ballistic shield comprises at least one clip, the at least one clip of the ballistic shield received by the at least one aperture of the mounting plate to engage the ballistic shield therewith until said user applies force to disengage the ballistic shield from the mounting plate.

7. The portable ballistic shield according to claim 5, wherein said mounting plate comprises at least one metallic engagement plate, and further wherein said ballistic shield comprises at least one magnet positioned thereon to engage said metallic engagement plate when said ballistic shield engages the mounting plate.

8. The portable ballistic shield and mount combination according to claim 5, further comprising a flashlight fastener attached to the ballistic shield for removably attaching a flashlight thereto.

9. A portable ballistic shield comprising:

a first portion comprising a hanger member for suspending the portable ballistic shield from an interior of a vehicle door; and a second portion comprising a ballistic shield, the ballistic shield comprising a handle extending therefrom such that a user of said ballistic shield can grasp the ballistic shield.

10. The portable ballistic shield according to claim 9, wherein said first portion and said second portion are releasably engaged with one another.

11. The portable ballistic shield according to claim 10, wherein said first portion comprises at least one aperture and said second portion comprises at least one clip, the at least one clip of the second portion received by the at least one aperture of the first portion to engage the second portion therewith until said user applies force to disengage the second portion from the first portion.

12. The portable ballistic shield according to claim 10, wherein said first portion comprises at least one metallic engagement plate, and further wherein said second portion comprises at least one magnet positioned thereon to engage said metallic engagement plate when said second portion engages the first portion.

13. The portable ballistic shield and mount combination according to claim 10, further comprising a flashlight fastener attached to the second portion for removably attaching a flashlight thereto.

* * * * *